US009050813B2

(12) United States Patent
Qing et al.

(10) Patent No.: US 9,050,813 B2
(45) Date of Patent: Jun. 9, 2015

(54) INK CARTRIDGE REFILLING DEVICE, INK CARTRIDGE REFILLING SYSTEM AND CORRESPONDING INK CARTRIDGE REFILLING METHOD

(75) Inventors: Lei Qing, Guangdong (CN); Bing Nie, Guangdong (CN)

(73) Assignee: ZHUHAI NINESTAR MANAGEMENT CO., LTD., Zhuhai, Guangdong (CN)

( * ) Notice: Subject to any disclaimer, the term of this patent is extended or adjusted under 35 U.S.C. 154(b) by 0 days.

(21) Appl. No.: 13/636,113

(22) PCT Filed: Jun. 9, 2011

(86) PCT No.: PCT/CN2011/075494

§ 371 (c)(1),
(2), (4) Date: Sep. 19, 2012

(87) PCT Pub. No.: WO2012/083644

PCT Pub. Date: Jun. 28, 2012

(65) Prior Publication Data

US 2013/0255826 A1 Oct. 3, 2013

(30) Foreign Application Priority Data

Dec. 22, 2010 (CN) ..... 2010 1 0603099

(51) Int. Cl.
*B41J 2/175* (2006.01)

(52) U.S. Cl.
CPC ..... *B41J 2/17506* (2013.01); *B41J 2/17513* (2013.01); *B41J 2/17553* (2013.01)

(58) Field of Classification Search
CPC ..... B65B 3/04; B41J 2/17506
USPC ..... 141/2, 5, 7, 8, 21, 25, 27, 65; 347/86–87
See application file for complete search history.

(56) References Cited

U.S. PATENT DOCUMENTS

| | | | | |
|---|---|---|---|---|
| 5,400,573 | A * | 3/1995 | Crystal et al. | 53/468 |
| 5,709,253 | A * | 1/1998 | Maerzke | 141/18 |
| 5,838,352 | A * | 11/1998 | Martinez | 347/87 |
| 6,332,481 | B1 * | 12/2001 | Shinada et al. | 141/18 |
| 6,474,796 | B1 * | 11/2002 | Ishinaga | 347/85 |
| 6,539,985 | B2 * | 4/2003 | Shinada et al. | 141/2 |
| 6,640,843 | B2 * | 11/2003 | Lee | 141/18 |
| 6,802,601 | B2 * | 10/2004 | Suzuki et al. | 347/86 |
| 7,344,215 | B2 * | 3/2008 | Cutler et al. | 347/7 |
| 7,690,741 | B2 * | 4/2010 | Tyvoll et al. | 347/7 |
| 8,733,909 | B2 * | 5/2014 | Qin et al. | 347/85 |
| 2001/0050113 | A1 * | 12/2001 | Shinada et al. | 141/18 |
| 2001/0052370 | A1 * | 12/2001 | Shinada et al. | 141/2 |

(Continued)

*Primary Examiner* — Nicolas A Arnett
(74) *Attorney, Agent, or Firm* — Jackson IPG PLLC; Demian K. Jackson

(57) ABSTRACT

The invention relates to an ink cartridge refilling device and an ink cartridge refilling system. The ink cartridge refilling device comprises an ink container, an ink injection channel, an air inlet channel, an aspirator and a cover component, wherein the cover component is provided with a first sealing section for sealing an ink cartridge to be refilled and a second sealing section for sealing the air inlet channel. During the ink refilling, air in a sealed ink cartridge can be sucked to enable ink in the ink container to flow into the sealed ink cartridge, so that negative pressure is formed in the ink container and the ink is conveyed from the ink container to the ink cartridge under the negative pressure, thus the refilling of the ink into the ink cartridge and the replenishing of air into the ink container may not be carried out at the same time.

22 Claims, 7 Drawing Sheets

(56) References Cited

U.S. PATENT DOCUMENTS

| | | | | |
|---|---|---|---|---|
| 2003/0056850 | A1* | 3/2003 | Lee | 141/18 |
| 2007/0024683 | A1* | 2/2007 | Yan | 347/86 |
| 2007/0132814 | A1* | 6/2007 | Chang et al. | 347/84 |
| 2008/0309741 | A1* | 12/2008 | Saikawa | 347/86 |
| 2013/0025743 | A1* | 1/2013 | Yuen | 141/65 |
| 2013/0037164 | A1* | 2/2013 | Qing et al. | 141/2 |
| 2013/0061982 | A1* | 3/2013 | Qin et al. | 141/18 |
| 2013/0135402 | A1* | 5/2013 | Qin et al. | 347/85 |

* cited by examiner

INK CARTRIDGE REFILLING DEVICE, INK CARTRIDGE REFILLING SYSTEM AND CORRESPONDING INK CARTRIDGE REFILLING METHOD

FIELD OF THE INVENTION

The invention relates to the inkjet technical field, in particular to an ink cartridge refilling device for refilling an ink cartridge under negative pressure, an ink cartridge refilling system and a corresponding ink cartridge refilling method.

BACKGROUND OF THE INVENTION

Inkjet printhead is a necessary component of an inkjet printer, wherein the inkjet printhead is arranged on a carriage of the inkjet printer, which moves back and forth, and ejects ink to a recording medium along with the movement of the carriage, so as to form an image on the recording medium. Ink cartridge is used as an ink storage container and is responsible to supply ink to the printhead. As the ink level of the ink cartridge is limited, a user needs to replace the ink cartridge after the ink in the ink cartridge is out. However, most used ink cartridges are thrown away but cannot be degraded naturally as the ink cartridges contain plastic cements, chips and the like, which would obviously cause resource waste and environmental pollution and increase the printing cost of users. Therefore, the most economical and environment-friendly mode is for the used ink cartridges to be refilled with ink so that the ink cartridges can be subjected to secondary utilization. Therefore, in order to meet the requirement, there are various ink cartridge refilling devices on the market.

The Chinese patent CN200620061311.X discloses a negative-pressure ink cartridge refilling device. The refilling device comprises an air suction mechanism and an ink injection mechanism, wherein the air suction mechanism consists of a cylinder and a piston; the cylinder consists of a sealed cavity and a connecting opening which connects the outside and the mentioned sealed cavity; the piston is pneumatically sealed inside the sealed cavity; the ink injection mechanism consists of an ink storage cavity and an ink injection opening which communicates the outside and the ink storage cavity; and the ink storage cavity is communicated with a section of the sealed cavity of the cylinder, which is positioned at the outside of the piston compared with the connecting opening, through a guide tube. The mode for utilizing the above mentioned negative-pressure ink cartridge refilling device for ink refilling is as follows: sucking ink into the ink storage cavity of the ink cartridge refilling device in advance, and aligning the connecting opening and the ink injection opening to an air suction hole and an ink injection hole of an ink cartridge respectively, so that the synchronized operation of two steps can be realized, namely air in the ink cartridge is sucked and removed on one hand while ink is refilled into the ink cartridge simultaneously on the other hand.

Obviously, as for an ink cartridge for utilizing a one-way valve to control the ink flowing direction, the above refilling method is comparatively convenient. However, as for an ink cartridge for utilizing a sponge to control the negative pressure in the ink cartridge, the refilling method has the defect that: as a sponge of a cavernous cavity tends to be in a supersaturated state after the ink refilling, the ink dropping phenomenon tends to occur if the ink cartridge after the ink refilling is directly taken off, thus the environment is polluted or hands, clothes, etc. of users are dirtied.

SUMMARY OF THE INVENTION

The invention provides an ink cartridge refilling device to solve the technical problem in the traditional ink cartridge refilling device that the ink dropping phenomenon tends to occur after an ink cartridge is filled with ink.

In order to solve the technical problem, the invention adopts the technical proposal that:

a negative-pressure ink cartridge refilling device for refilling ink into an ink cartridge to be refilled, comprising:

an ink container used for storing ink for refilling;

an ink injection channel communicated with the ink container and used for conveying the ink in the ink container to the ink cartridge to be refilled;

an air inlet channel communicated with the ink container and used for replenishing air into the ink container;

an aspirator used for sucking air in the ink cartridge to be refilled; and a cover component, wherein the cover component is provided with a first sealing section for sealing the ink cartridge to be refilled and a second sealing section for sealing the air inlet channel.

The ink cartridge refilling device also comprises an ink cartridge positioning mechanism for positioning the ink cartridge to be refilled on the ink cartridge refilling device; and the ink cartridge positioning mechanism is connected with the cover component through a rotating shaft.

The first sealing section is closer to the rotating shaft compared with the second sealing section.

The first sealing section is a first elastic pad which is arranged on the cover component, and the second sealing section is a second elastic pad which is arranged on the cover component.

The first sealing section consists of a convex section which is convex from the cover component and an elastic sleeve which is engaged with the convex section.

The second sealing section consists of an extended section which is extended from the cover component and a sealing element which is engaged with the extended section.

The ink cartridge refilling device is also provided with a delay action component to enable the first sealing section to be still in the state of sealing the ink cartridge to be refilled after the air inlet channel is opened by the second sealing section.

The delay action component is an elastic component which is engaged with the first sealing section.

The deformation of the first elastic pad is larger than that of the second elastic pad.

The deformation of the elastic sleeve is larger than that of the sealing element.

The cover component is also provided with extended clamp hooks, and the positioning mechanism is provided with clamping grooves which are engaged with the extended clamp hooks.

The invention also provides an ink cartridge refilling system to solve the problem: and a corresponding ink cartridge refilling method.

A negative-pressure ink cartridge refilling system comprises the ink cartridge to be refilled and the above ink cartridge refilling device.

The ink cartridge to be refilled comprises a cavity for storing ink, a sponge arranged inside the cavity for maintaining the negative pressure in the ink cartridge, an ink outlet for introducing ink in an ink storage cavity to the outside of the ink cartridge, an air inlet for replenishing air into the ink storage cavity and an ink injection opening for injecting ink into the ink storage cavity.

The cavity body consists of the ink storage cavity for receiving the ink and a negative-pressure cavity for receiving the sponge.

The first sealing section is arranged on the cover component, at a position corresponding to the air inlet of the ink cartridge to be refilled.

A through hole is reserved on the cover component, at a position corresponding to the ink injection opening of the ink cartridge to be refilled.

A movable mandrel is arranged at the through hole and used for removing the sealing element for sealing the ink injection opening.

The invention also provides an ink cartridge refilling method to solve the problem:

The refilling method for utilizing the ink cartridge refilling system for ink cartridge refilling comprises the following steps of:

A. sealing the ink cartridge to be refilled and the air inlet channel to form a closed space between the ink cartridge to be refilled and the ink cartridge refilling device;

B. sucking air in the ink cartridge to be refilled by the aspirator; and

C. opening the air inlet channel and canceling the sealing of the ink cartridge to be refilled.

The refilling method also comprises the following step before the step A: opening the ink injection opening of the ink cartridge to be refilled, and assembling a rubber plug into the ink injection opening.

In the step C, the air inlet channel is opened first, and then the sealing of the ink cartridge to be refilled is canceled.

In the step C, the air inlet channel is opened and simultaneously the sealing of the ink cartridge to be refilled is canceled.

The refilling method also comprises the following step after the step C is over: taking off the ink cartridge to be refilled from the ink cartridge refilling device, and sealing the air inlet channel again.

By adoption of the technical proposal, as the cover component is provided with the first sealing section for sealing the ink cartridge to be refilled and the second sealing section for sealing the air inlet channel, air in a sealed ink cartridge can be sucked to enable ink in the ink container to flow into the sealed ink cartridge during the ink refilling, thus negative pressure is formed in the ink container and the ink is conveyed from the ink container to the ink cartridge under the negative pressure, consequently the refilling of the ink into the ink cartridge and the replenishing of the air into the ink container may not be carried out at the same time. Therefore, the inside of the ink cartridge refilling device is in the negative pressure state after the ink cartridge is fully refilled and redundant ink in a sponge can be removed when the refilling device is opened, which solves the technical problem in the traditional ink cartridge refilling device that the ink dropping phenomenon can occur after an ink cartridge is filled with ink.

DETAILED DESCRIPTION OF THE PREFERRED EMBODIMENTS

Clear and comprehensive description is given to the technical proposal of the embodiments of the invention with the attached drawings of the embodiments of the invention for the purpose of clearer objects, technical proposal and advantages of the embodiments of the invention. Obviously, the embodiments described are only part of the embodiments of the invention and not all the embodiments. All the other embodiments achieved by those skilled in the art based on the embodiments of the invention on the premise of not making creative work are within the scope of protection of the invention.

The main technical proposal of the invention is as follows: as a cover component is provided with a first sealing section for sealing an ink cartridge and a second sealing section for sealing an air inlet channel, a closed space is formed between an ink cartridge refilling device and the ink cartridge when the ink cartridge refilling device is utilized to refill the ink cartridge and outside air cannot be replenished into an ink container, thus negative pressure is formed in the ink cartridge after the ink refilling and the outside air can be replenished into the ink cartridge when the ink cartridge refilling device is opened, consequently redundant ink in the ink cartridge can flow into the ink container. Therefore, the ink dropping phenomenon will not occur.

Further description is given to the technical proposal of the invention with the attached drawings and preferred embodiments.

Embodiment 1

Figure 1A:
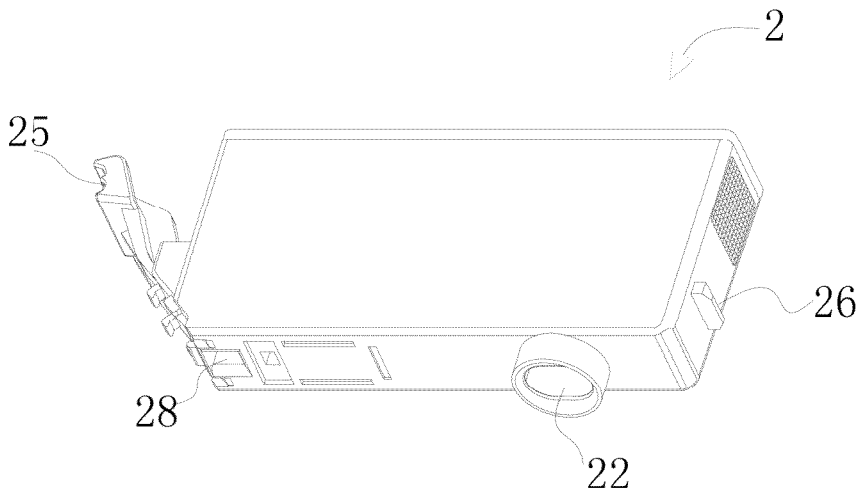
FIG. 1*a* is an external view of an ink cartridge of the embodiments 1 and 2.

An ink cartridge 1 for an inkjet printer is detachably installed on the inkjet printer and used for supplying ink to an inkjet printhead for the inkjet printer so as to form images or words on a recording medium. FIG. 1*a* is an external view of an ink cartridge to be refilled 2 in the embodiment, and FIG. 1*b* is a structure diagram of the ink cartridge to be refilled 2.

As illustrated in FIG. 1*a*, the ink cartridge 2 comprises a cartridge body and a cartridge cover, both of which are made of plastics and fixedly connected with each other by welding to form a closed cavity. As illustrated in FIG. 1*b*, the closed cavity is divided into a negative-pressure cavity 21 and an ink storage cavity 20 by a separation plate 29, wherein the negative-pressure cavity 21 and the ink storage cavity 20 are communicated with each other only through a communicating opening 291 under the separation plate 29; ink for printing is stored in the ink storage cavity 20; and a closed space is basically formed in the ink storage cavity 21 except for the communicating opening 291. The negative-pressure cavity 21 is provided with an adsorbing member for holding the ink, and the adsorbing member is mostly made of porous materials and is preferably a sponge 211 in the embodiment, namely the sponge 211 can adsorb and hold the ink by utilization of the capillary force of the sponge 211, thus the negative pressure in the ink cartridge 2 can be controlled. Moreover, an ink outlet 22 for introducing the ink in the ink cartridge 2 to the printhead for the printer is also arranged at the bottom of the negative-pressure cavity 21, and an air inlet 23 for replenishing outside air into the ink cartridge 2 is also arranged at the top wall of the negative-pressure cavity 21. Therefore, when the ink in the negative-pressure cavity 21 is used for printing on a recording medium, the ink in the ink storage cavity 20 enters into the negative-pressure cavity 21 through the communicating opening 291 and simultaneously air in the negative-pressure cavity 21 also enters into the ink storage cavity 20 through the communicating opening 291, namely the ink in the ink storage cavity 20 and the air in the negative-pressure cavity 21 are subjected to gas-liquid exchange at the communicating opening 291. In addition, along with the continuous gas-liquid exchange, the outside air can be replenished into the ink cartridge 2 through the air inlet 23.

Figure 1B:
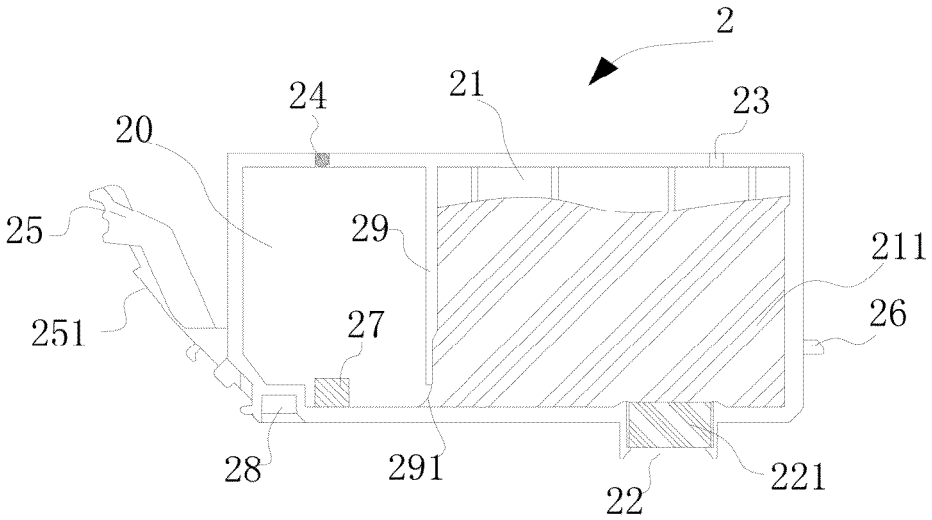
FIG. 1*b* is a structural diagram of the ink cartridge.

As illustrated in FIG. 1*b*, the ink outlet 22 is also provided with a cotton core 221 of which the density is higher than that of the sponge 211 in the negative-pressure cavity 21, and the cotton core 221 is in contact with an ink supply end on the printer to introduce ink to flow to the ink outlet 22 and be supplied to the printhead through the ink supply end when the ink cartridge 2 is installed on the printer. Moreover, the ink cartridge 2 is also provided with an ink injection opening 24 which is used for injecting ink into the ink cartridge 2. In the embodiment, the ink injection opening 24 is arranged on the ink storage cavity 20 and sealed by a steel ball after the ink refilling for the first time, so that the leakage phenomenon of the ink cartridge 2 when transported or used can be prevented. As illustrated in FIG. 1*b*, a prism 27 for detecting the ink-out state of the ink cartridge 2 is also arranged at the bottom wall of the ink storage cavity 20. The process of detecting the ink level by adoption of the prism 27 belongs to the mature technology of the field and is not explained in detail here. Furthermore, as illustrated in FIGS. 1*a* and 1*b*, a movable member 25 provided with a first engagement section 251 and a second engagement section 26 are also arranged on both sidewalls of the ink cartridge 2, and a concave section 28 is also arranged at the bottom wall of the ink cartridge 2, close to the movable member 25. The concave section 28 can be engaged with a locking mechanism of the printer when the ink cartridge 2 is installed into the printer, so as to fix the ink cartridge 2 into the printer.

Figure 2A:
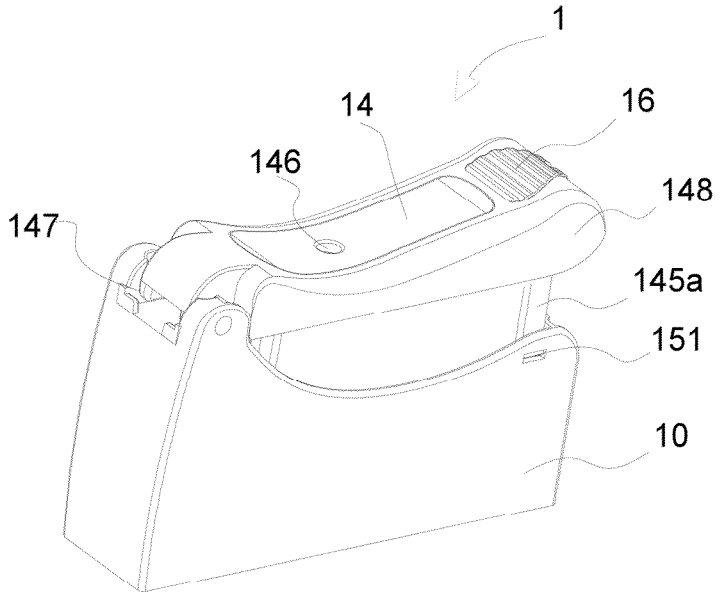
FIG. 2*a* is an external view of an ink cartridge refilling device of the embodiment 1.
Figure 2B:
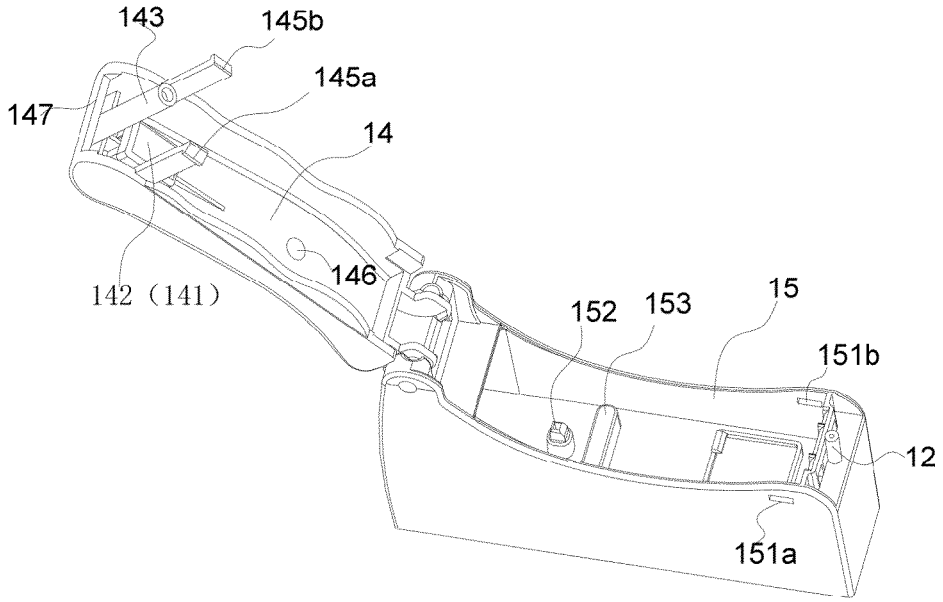
FIG. 2*b* is a schematic diagram of the ink cartridge refilling device in the opened state.
Figure 3:
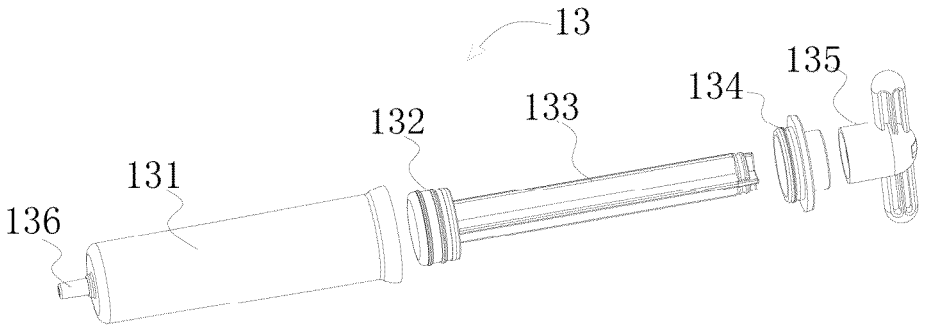
FIG. 3 is an exploded view of an aspirator of the embodiment 1.

FIG. 2*a* is an external view of ink cartridge refilling device 1 of the embodiment, and FIG. 2*b* is a schematic diagram of the ink cartridge refilling device 1, in the opened state, of the embodiment. As illustrated in FIGS. 2*a* and 2*b*, the ink cartridge refilling device 1 comprises an ink container 10, an ink injection channel 11, an air inlet channel 12, an aspirator 13, an ink cartridge positioning mechanism 15 and a cover component 14, wherein the ink container 10 is used for storing ink to be conveyed to the ink cartridge to be refilled 2 during the refilling; the ink injection channel 11 is arranged inside the ink container 10 and used for conveying the ink in the ink container to the ink cartridge 2 and comprises an outlet end 111 which is connected with an ink outlet 22 of the ink cartridge 2 and an inlet end 112 which introduces the ink to flow into the channel from the ink container 10; the air inlet channel 12 is arranged on the ink container 10 and used for replenishing air into the ink container 10 from the outside and comprises an air inlet end 121 which is communicated with outside air and an air outlet end 122 which is communicated with the ink container 10; and the aspirator 13 is connected with the ink injection opening 24 of the ink cartridge 2, so as to suck air in the ink cartridge 2. As illustrated in FIG. 3, the aspirator 13 consists of a cylinder body 131, a piston 132, a piston rod 133, a cylinder cover 134, a handle 135 and a suction nozzle 136, wherein the suction nozzle 136 and the cylinder 131 are integrated into a whole; the cylinder body 131 and the cylinder cover 134 are connected with each other to form a closed space; and the piston 132 and the piston rod 133 are fixedly connected with each other and the handle 135 and the piston rod 133 are connected with each other, so that the piston 132 can be pulled by a user by holding the handle 135 to pull the piston rod 133, and be driven to move up and down in the cylinder body 131 to suck or discharge air. The ink cartridge positioning mechanism 15 is used for positioning the ink cartridge 2 on the ink cartridge refilling device 1. As illustrated in FIG. 2*b*, corresponding mechanisms which are engaged with the first engagement section 251 and the second engagement section 26 of the ink cartridge 2 are arranged on the ink cartridge positioning mechanism 15, and a supporting section 153 which leans against the bottom wall of the ink cartridge 2 and a positioning column 152 which is engaged with the concave section 28 of the ink cartridge 2 are arranged at the bottom wall of the ink cartridge positioning mechanism 15. Obviously, the ink cartridge 2 can be exactly positioned inside the ink cartridge refilling device 1. In addition, the positioning mechanism 15 and the ink container 10 can be integrated into a whole by clamping connection or welding. In the embodiment, in order to reduce the manufacturing process, the positioning mechanism 15 and the ink container 10 are preferably integrated into a whole by injection molding. As illustrated in FIG. 2*b*, clamping grooves 151*a* and 151*b* are respectively arranged on both sidewalls of the positioning mechanism 15. The cover component 14 is arranged on the ink container 10 and used for fixing the ink cartridge 2 into the ink cartridge refilling device 1. In the embodiment, the cover component 14 is preferably connected with the ink cartridge positioning mechanism 15 through a rotating shaft. As illustrated in FIG. 2*b*, to be more specific, one end of the cover component 14 is a connecting end 147 which is connected with the positioning mechanism 15 through the rotating shaft, namely the cover component 14 can be rotated to a certain angle around the positioning mechanism 15; and the other end of the cover component 14 is a free end 148. Moreover, two extended clamp hooks 145*a* and 145*b* which are extended from the inside of the cover component 14 are also arranged near the free end 148 and can be clamped with the two clamping grooves 151*a* and 151*b* of the ink cartridge positioning mechanism 15, so that the cover component 14 can fix the ink cartridge 2 on the ink cartridge refilling device 1 after the ink cartridge 2 is assembled into the ink cartridge positioning mechanism 15.

Figure 4A:
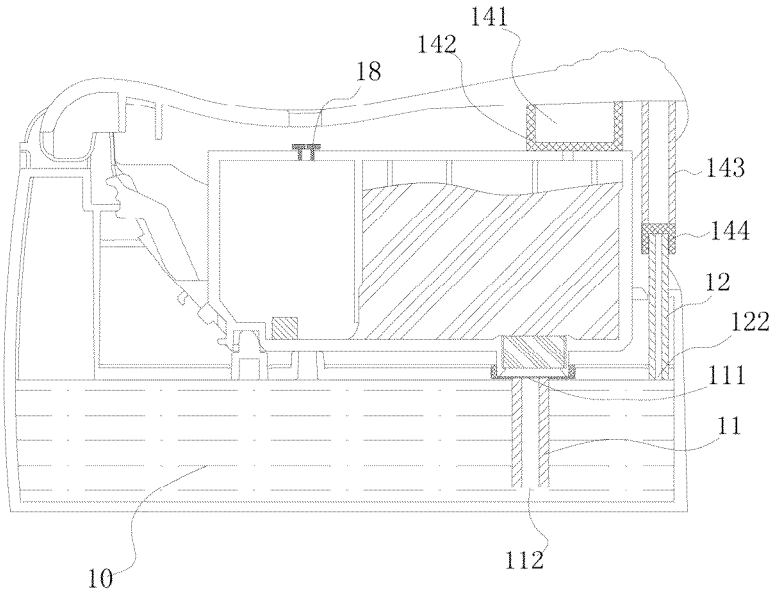
FIG. 4*a* is a state diagram 1 of the ink cartridge refilling device and the ink cartridge of the embodiment 1—the state when the ink cartridge is assembled.

As illustrated in FIGS. 2*b* and 4*a*, the cover component 14 is also provided with a first sealing section and a second sealing section which enable the ink cartridge 2 and the ink cartridge refilling device 1 to be in a sealed state during the refilling, wherein the first sealing section may be an elastic pad which is arranged on the cover component 14, at a position corresponding to the air inlet 23 of the ink cartridge 2, and the thickness of the elastic pad can be determined according to the distance between the inside of the cover component 14 and the top wall of the ink cartridge 2. However, in the embodiment, in order to guarantee the sealability of the ink cartridge 2, the first sealing section is preferably composed of a convex section 141 and an elastic sleeve 142, wherein the convex section 141 is convex from the inside of the cover component 14 and arranged inside the cover component 14, at a position corresponding to the air inlet 23 of the ink cartridge 2; to be specific, the convex section 141 can cover the upper part of the air inlet 23 when the cover component 14 and the ink cartridge positioning mechanism 15 are clamped with each other; and the elastic sleeve 142 is made of elastic materials such as silica gel and rubber, has the same dimension with the convex section 141, and is used for enclosing the convex section 141. The second sealing section may also be an elastic pad which is arranged on the cover component 14, at a position corresponding to the air inlet channel 12. However, in order to guarantee the sealability and the maneuverability of the air inlet channel 12, the second sealing section in the embodiment is preferably composed of a sealing element 144 and an extended section 143 which is extended from the cover component 14, wherein the extended section 143 is arranged inside the cover component 14, at a position corresponding to the air inlet channel 12; to be specific, the extended section 143 can cover or enclose the air inlet end 121 of the air inlet channel 12 when the cover component 14 and the ink cartridge positioning mechanism 15 are clamped with each other; the sealing element 144 is also made of elastic materials as the same with the elastic sleeve 142; and a concave section is arranged on the sealing element 144. The diameter of the concave section is equivalent to the outside diameter of the air inlet end 121 of the air inlet channel 12, and the outside diameter of the sealing element 144 is equivalent to the inside diameter of the extended section 143. That is to say, the sealing element 144 is assembled inside the extended section 133 in general and can be used to directly seal the air inlet channel 12 when the cover component 14 and the positioning mechanism 15 are clamped with each other. It should be understood by those skilled in the art that the sealing element 144 can also be a gasket of which the area is equivalent to that of the end face of the extended section 143, and the gasket is welded on the end face of the extended section 143, which is in contact with the air inlet channel 12; and the sealing element 144 can also be a silica gel sleeve which is engaged with the extended section 143.

Therefore, it can be seen from the structural description of the first sealing section and the second sealing section that: after the ink cartridge 2 is assembled into the refilling device 1, when the cover component 14 is rotated around the positioning mechanism 15 to fix the ink cartridge 2, the first sealing section can seal the air inlet 23 of the ink cartridge 2 and the second sealing section can seal the air inlet channel 12 of the refilling device 1, so that the outside air cannot flow into the ink cartridge 2 and the ink container 10, thus a closed space is formed between the ink cartridge 2 and the ink container 10 which are isolated from the outside. In addition, the first sealing section and the second sealing section can limit the movement of the ink cartridge 2 on the refilling device 1, namely the ink cartridge 2 cannot move upwards, thus the complete fixation of the ink cartridge 2 inside the ink cartridge refilling device 2 is guaranteed.

As illustrated in FIG. 2*b*, the extended section 143 is arranged between the two extended clamp hooks 145*a* and 145*b* and is closer to the free end 148 compared with the two clamp hooks, and the convex section 141 is arranged to be more far away from the free end 148 compared with the extended section 143. That is to say, the first sealing section is arranged to be closer to the connecting end 147 compared with the second sealing section. It can be seen from the position distribution of the extended section 143 and the convex section 141 that: as the cover component 14 performs angular rotary motion around a shaft, when the ink cartridge 2 is assembled on the refilling device 1 for ink refilling and the cover component 14 performs clockwise rotation to be clamped with the positioning mechanism 15 and seal the whole refilling device 1, the ink cartridge 2 is sealed by the convex section 141 and the elastic sleeve 142 first, and then the air inlet channel 12 is sealed by the extended section 143 and the sealing element 144; after the ink refilling of the ink cartridge 2 is completed, when the cover component 14 performs counterclockwise rotation to be not clamped with the positioning mechanism 15 and open the whole refilling device 1, the extended section 143 and the sealing element 144 are detached from the air inlet channel 12 first, and then the convex section 141 and the elastic sleeve 142 are detached from the ink cartridge 2. That is to say, the air inlet channel 12 is opened first, and then the sealing of the ink cartridge 2 is canceled. Therefore, after the ink refilling is completed and the refilling device 1 is opened, the air can be replenished into the ink container 10 first and then replenished into the ink cartridge 2, so that redundant ink can be removed, thus the reflowing of redundant ink in the ink cartridge 2 into the ink container 10 can be prevented. The distance between the extended section 143 and the convex section 141 can be determined according to different ink cartridge structures.

Moreover, in order to guarantee the opening sequence of the first sealing section and the second sealing section, the deformation of the elastic sleeve 142 in the embodiment is preferably larger than that of the sealing element 144, so that the ink cartridge 2 can be still maintained to be sealed by the first sealing section after the air inlet channel 12 is opened by the second sealing section. Similarly, it should be understood by those skilled in the art that when the first sealing section and the second sealing section are respectively the first elastic pad and the second elastic pad set on the cover, the deformation of the first sealing section is also larger than that of the second sealing section, so that the first elastic pad can be still maintained to be in the sealed state after the second elastic pad is opened, namely the thickness of the first sealing section is larger than that of the second sealing section.

As illustrated in FIG. 2*a*, a through hole 146 is reserved on the cover component 14, at a position corresponding to the ink injection opening 24 of the ink cartridge 2. The diameter of the through hole 146 is equivalent to that of the ink injection opening 24, so that the suction nozzle 136 of the aspirator 13 is connected with the ink injection opening 24 through the through hole 146 during the refilling. Moreover, a gasket 113 is arranged at the outlet end 111 of the ink injection channel 11 and made of elastic materials such as silica gel and rubber, and can be a common seal ring which is taken off during the refilling and assembled after the refilling. In the embodiment, the gasket 113 is preferably a self-closing gasket, and a self-closing slot is reserved on the self-closing gasket. The self-closing gasket is in the closed state at normal times and can only be opened when the pressure difference at both sides of the ink cartridge 2 and the ink container 10 reaches the predetermined value. In addition, as illustrated in FIG. 2*a*, a friction section 16 is also arranged at the free end 148 of the cover component 14 and formed by a plurality of concave-convex groove parts. The object of the friction section 16 is to increase the friction force between a hand of a user and the cover component 14 and guarantee that the hand of the user cannot slide easily when the user handles the cover component 14 for opening or closing the refilling device 1.

For the user to clearly observe the refilling condition of the ink cartridge, the ink cartridge refilling device 1 is preferably made of transparent materials in the embodiment.

The process of refilling ink into the ink cartridge 2 by adoption of the ink cartridge refilling device 1 is illustrated according to FIGS. 4*a* to 4*e*.

(1) Placing the ink cartridge refilling device 1 on a plane, opening the ink injection opening 24 of the ink cartridge 2 by utilizing an available opening tool, and assembling a rubber plug 18 into the ink injection opening 24.

(2) Assembling the ink cartridge 2 into the ink cartridge refilling device 1 as illustrated in FIG. 4*a*, wherein the first engagement section 251, the second engagement section 26, the concave section 28 and the bottom wall of the ink cartridge 2 are respectively engaged with corresponding members on the ink cartridge positioning mechanism 15, and the ink outlet 22 is connected with the outlet end 111 of the ink injection channel 11; and rotating the cover component 14 clockwise, so that the extended clamp hooks 145*a* and 145*b* on the cover component 14 are engaged with the clamping grooves 151*a* and 151*b* of the ink cartridge positioning mechanism 15, thus the convex section 141 and the elastic sleeve 142 of the cover component 14 lean against a cartridge cover of the ink cartridge 2 to seal the air inlet 23 while the air inlet channel 12 is sealed by the extended section 143 and the sealing element 144 of the cover component 14. Herein, a closed space is formed between the ink cartridge 2 and the ink cartridge refilling device 1 which are combined into an ink cartridge refilling system.

Figure 4B:
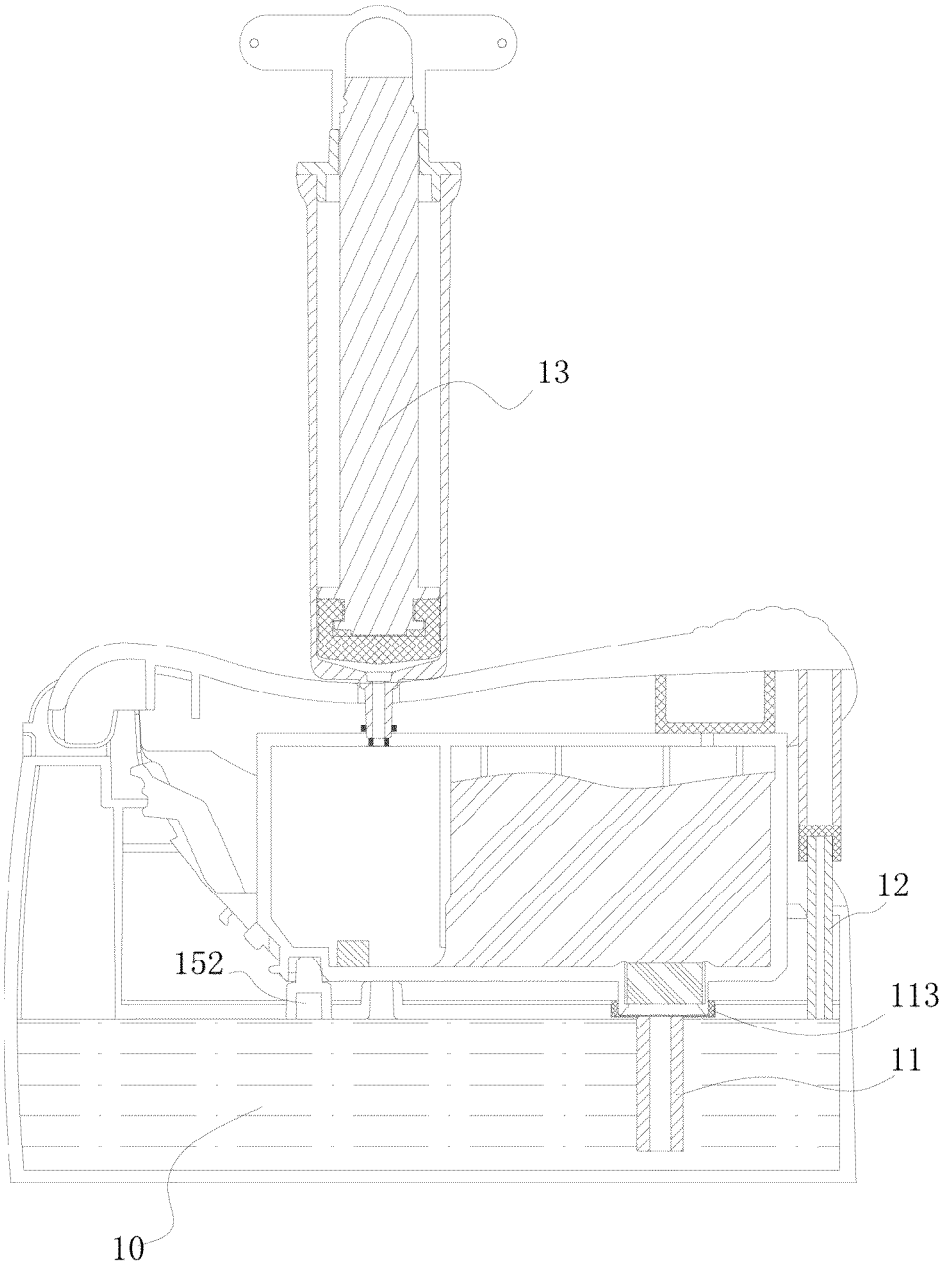
FIG. 4*b* is a state diagram 2 of the ink cartridge refilling device and the ink cartridge of the embodiment 1—the state when the aspirator is inserted.
Figure 4C:
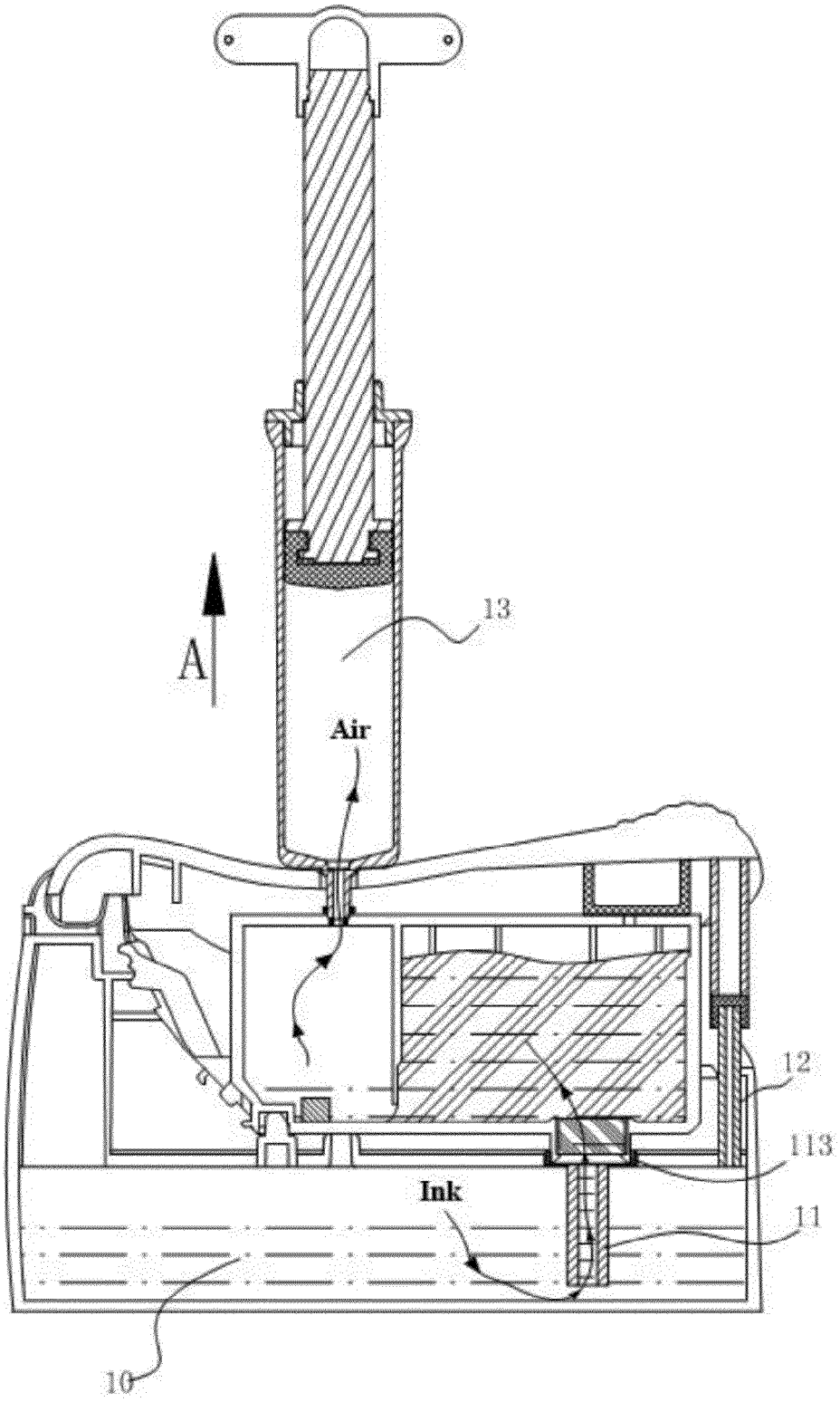
FIG. 4*c* is a state diagram 3 of the ink cartridge refilling device and the ink cartridge of the embodiment 1—the sucking step.

(3) Inserting the prepared aspirator 13 into the ink injection opening 24 through the through hole 146 and enabling the aspirator 13 to pass through the rubber plug 18 as illustrated in FIG. 4*b*, so that the aspirator 13 and the ink cartridge 2 are communicated with each other; and holding the handle 135 of the aspirator 13 and pulling up the piston rod 133 along the direction A shown in the figure to drive the piston 132 to move upwards as illustrated in FIG. 4*c*, so that air in the ink cartridge 2 can flow into the aspirator 13 along the arrowhead direction shown in FIG. 4*c*. Herein, the pressure in the ink cartridge 2 becomes low and certain negative pressure is formed in the ink cartridge 2, namely pressure difference is formed between the ink cartridge 2 and the ink container 10. The self-closing slot of the gasket 113 can be opened under the action of the pressure difference, and the ink in the ink container 10 can flow into the ink cartridge 2 along the arrowhead direction shown in FIG. 4*c* under the action of the pressure difference. Herein, the air inlet channel 12 is maintained to be in the closed state while the ink cartridge 2 is still in the sealed state.

Figure 4D:
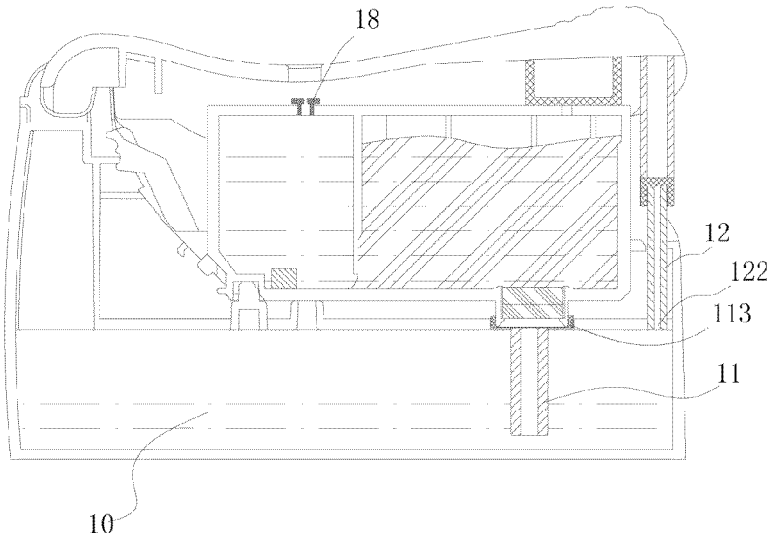
FIG. 4*d* is a state diagram 4 of the ink cartridge refilling device and the ink cartridge of the embodiment 1—the state when the ink refilling is completed.
Figure 4E:
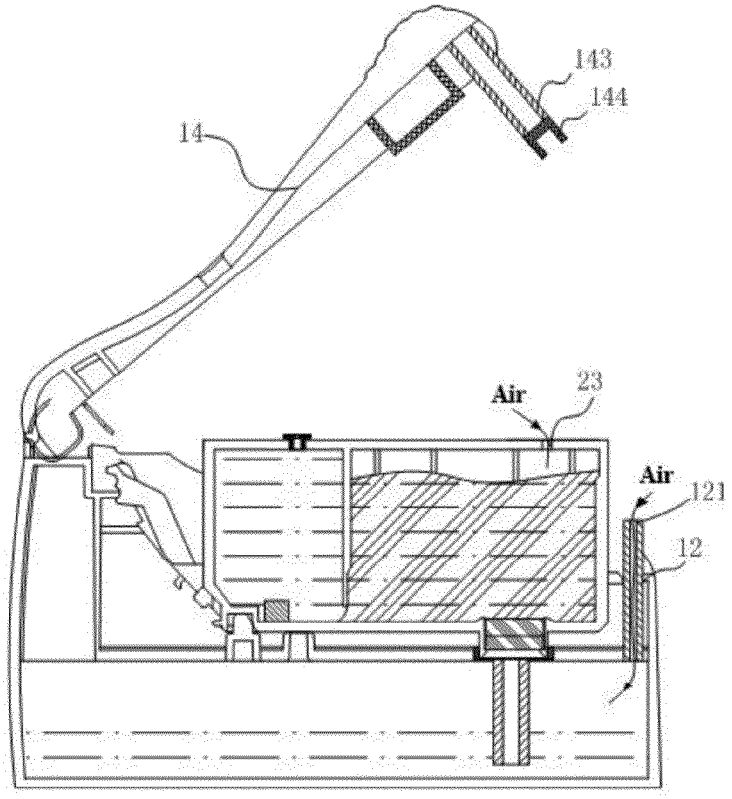
FIG. 4*e* is a state diagram 5 of the ink cartridge refilling device and the ink cartridge of the embodiment 1—the state when the refilling device is opened.

(4) Taking off the aspirator 13 when the ink cartridge 2 is filled with ink as illustrated in FIG. 4*d*, so that the extended clamp hooks 145*a* and 145*b* of the cover component 14 are detached from the clamping grooves 151*a* and 151*b* of the positioning mechanism 15; rotating the cover component 14 counterclockwise, so that the ink cartridge refilling device 1 and the ink cartridge 2 are converted to an opened space from the closed space. As illustrated in FIG. 4*e*, the air inlet channel 12 is opened, and air is replenished into the ink container 10 through the air inlet end 121 and the air outlet end 122; and the sealing of the ink cartridge 2 is canceled, and air is replenished into the ink cartridge 2 through the air inlet 23. Herein, the ink cartridge 2 and the ink container 10 achieve the pressure balance, and the self-closing slot of the gasket 113 is closed.

(5) Taking off the ink cartridge 2; rotating the cover component 14 to be engaged with the positioning mechanism 15 again; and sealing the air inlet channel 12 again, so that the ink cartridge refilling device 1 is hermetically placed.

The rubber plug 18 assembled into the ink injection opening 24 can be a common elastic seal ring. In the embodiment, the rubber plug 18 is preferably a self-closing seal ring which can be opened or closed according to the pressure difference between the inside and the outside of the ink cartridge. The self-closing seal ring is in the opened state when the aspirator 13 is inserted and is in the closed state when the aspirator 13 is not inserted.

Figure 4F:
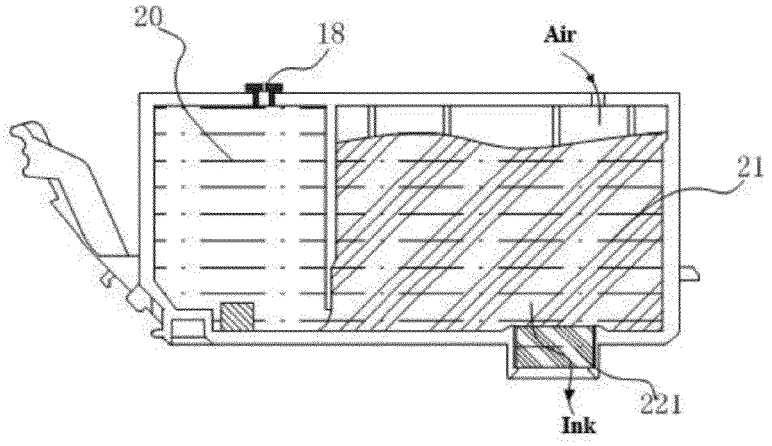
FIG. 4*f* is a schematic diagram indicating the flow of a fluid in the ink cartridge of FIG. 4*e;*

It should be understood by those skilled in the art that the "matter balance principle" is followed during the ink refilling, namely the mass of matters flowing out of a container is equivalent to that of matters flowing into the container. For example, the volume of the ink flowing out of the ink storage cavity of the refilling tool mentioned in the background of the invention is equivalent to the volume of air replenished into the ink storage cavity. However, in the technical proposal, it can be seen from the refilling process that the ink container 10 is maintained to be in the closed state during the sucking and air is not replenished into the ink container 10. That is to say, the ink refilling of the ink cartridge 2 enables the pressure in the ink container 10 to be unbalanced and is continued under the condition of unbalanced pressure in the ink container 10, namely the refilling of ink into the ink cartridge and the replenishing of air into the ink container are not carried out at the same time. The reason for adopting the mode is as follows: in the prior art, the sponge 211 and the cotton core 221 in the ink cartridge 2 tend to be in the supersaturated state after the ink refilling, namely there is redundant ink in the negative-pressure cavity 21, thus the ink dropping phenomenon tends to occur when the ink cartridge 2 is taken off at the time; but in the technical proposal, a closed space is formed between the ink cartridge 2 and the ink container 10 during the refilling, so that large negative pressure can be formed in the ink container 10 when air in the ink cartridge 2 is sucked to enable ink in the ink container 10 to flow into the ink cartridge 2 and air is not replenished into the ink container 10 in time. As the ink container 10 is communicated with the ink cartridge 2, there is also negative pressure in the ink cartridge 2 at the time. Therefore, outside air can be replenished into the ink container 10 under the action of the negative pressure when the cover component 14 is opened, and meanwhile the air can be also replenished into the ink cartridge 2. To be specific, as illustrated in FIG. 4*f*, the air can be replenished into the negative-pressure cavity 21 through the air inlet 23, and redundant ink in the sponge 211 and the cotton core 221 can flow into the ink container 10 at the time due to the matter balance principle, so that the sponge 211 and the cotton core 221 are in the unsaturated state, thus the ink dropping phenomenon cannot occur when the ink cartridge 2 is taken off.

Embodiment 2

Figure 5:
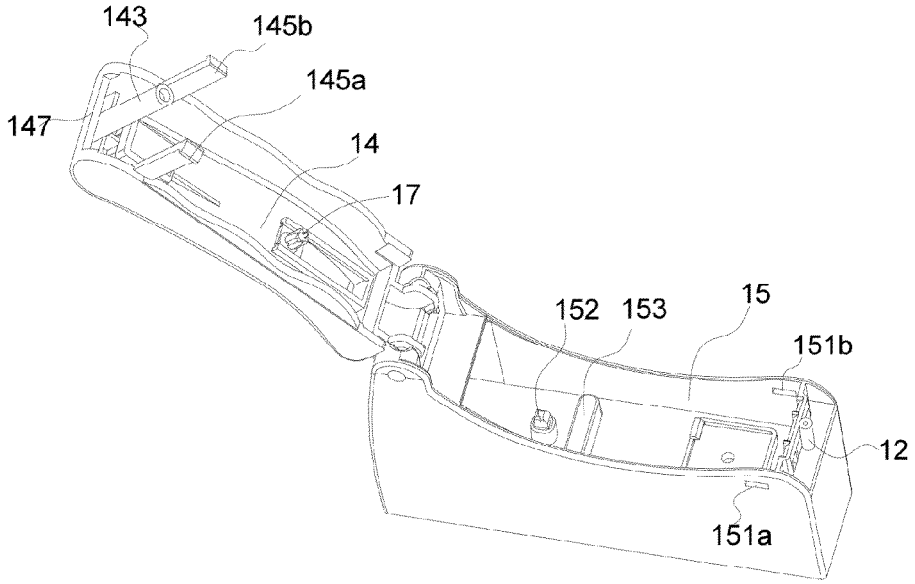
FIG. 5 is a schematic diagram of the ink cartridge refilling device of the embodiment 2.

For the purpose of reducing the cost of additional purchase of the opening tool and achieving simpler operation, the "opening" function is added in the embodiment on the basis of the embodiment 1. FIG. 5 is a schematic diagram of the ink cartridge refilling device, in the opened state, of the embodiment. Same components in the embodiment have same symbols with those in the embodiment 1.

As illustrated in FIG. 5, a mandrel 17 used for removing a steel ball for sealing the ink injection opening 24 is arranged at the through hole 146 of the cover component 14; a concave face which is engaged with the steel ball of the ink injection opening 24 is arranged at the top of the mandrel 17; a plurality of linear grooves at different lengths are arranged on the side face of the mandrel 17, so that the concave face and the side face of the mandrel 17 are combined to form an edge provided with a plurality of blade parts. In the embodiment, the mandrel 17 is arranged to be movable, and to be specific, arranged to be able to slide back and forth on the cover component 14, namely the mandrel 17 can slide back and forth at the opening position and the non-opening position. It should be understood by those skilled in the art that the mandrel 17 can also be arranged to be able to be removed from the cover component 14. That is to say, firstly, the mandrel 17 is taken off after the opening action is completed; secondly, a refilling tool is utilized for ink refilling; and thirdly, the mandrel 17 is reset after the ink refilling.

Other structures of the ink cartridge refilling device in the embodiment are similar to those in the embodiment 1 and are not explained in detail here.

The process of refilling the ink cartridge by utilizing the ink cartridge refilling device of the embodiment is described as follows:

(1) Placing the ink cartridge refilling device 1 on a plane; assembling the ink cartridge 2 into the ink cartridge refilling device 1, wherein the first engagement section 251, the second engagement section 26, the concave section 28, etc. of the ink cartridge 2 are all engaged with corresponding members on the positioning mechanism 15, the ink outlet 22 is connected with the outlet end 111 of the ink injection channel 11, and herein the mandrel is at the opening position; rotating the cover component 14 clockwise to enable the mandrel 17 to be engaged with the steel ball in the ink injection opening 24; pressing down the cover component 14 forcibly from the free end 148, so that the steel ball in the ink injection opening 24 can be extruded into the ink cartridge 2 by the mandrel 17, thus the ink injection opening 24 is opened; enabling the mandrel 17 to slide to the non-opening position, namely a position deviated from a position corresponding to the ink injection opening 24; and assembling a rubber plug 18 into the ink injection opening 24.

(2) Enabling the cover component 14 and the ink cartridge positioning mechanism 15 to be clamped with each other, so that the convex section 141 and the elastic sleeve 142 of the cover component 14 lean against a cartridge cover of the ink cartridge 2 to seal the air inlet 23 while the air inlet channel 12 is sealed by the extended section 143 and the sealing element 144 of the cover component 14. Herein, a closed space is formed between the ink cartridge 2 and the ink cartridge refilling device 1 which are combined into an ink cartridge refilling system.

(3) Inserting the prepared aspirator 13 into the ink injection opening 24; pulling up the piston 132, so that air in the ink cartridge 2 can flow into the aspirator 13. Herein, the pressure in the ink cartridge 2 becomes low and certain negative pressure is formed in the ink cartridge 2, namely pressure difference is formed between the ink cartridge 2 and the ink container 10. The self-closing slot of the gasket 113 is opened under the action of the pressure difference, and the ink in the ink container 10 flows into the ink cartridge 2 under the action of the pressure difference. Herein, the air inlet channel 12 is maintained to be in the closed state while the ink cartridge 2 is still in the sealed state.

(4) Taking off the aspirator 13 when the ink cartridge 2 is filled with ink, so that the cover component 14 is detached from the positioning mechanism 15; rotating the cover component 14 counterclockwise, so that the ink cartridge refilling device 1 and the ink cartridge 2 are converted to an opened space from the closed space. Therefore, the air inlet channel 12 is opened, and air is replenished into the ink container 10 through the air inlet end 121 and the air outlet end 122; and the sealing of the ink cartridge 2 is canceled, and air is replenished into the ink cartridge 2 through the air inlet 23. Herein, the ink cartridge 2 and the ink container 10 achieve the pressure balance, and the self-closing slot of the gasket 113 is closed.

(5) Taking off the ink cartridge 2; rotating the cover component 14 to be engaged with the positioning mechanism 15 again; and sealing the air inlet channel 12 again, so that the ink cartridge refilling device 1 is hermetically placed.

Embodiment 3

For the purpose of guaranteeing that the air inlet channel is opened first and then the sealing of the ink cartridge is canceled during the refilling, a delay action component is added in the embodiment on the basis of the embodiments 1 and 2 and used for guaranteeing that the air inlet channel is opened by the second sealing section while the ink cartridge to be refilled is still sealed by the first sealing section.

Figure 6:
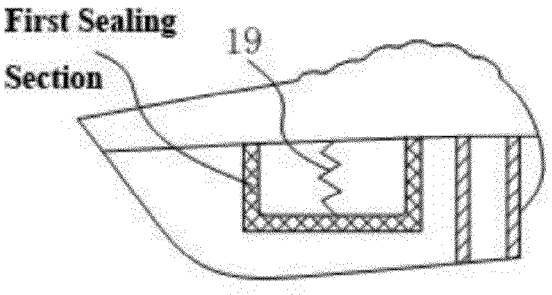
FIG. 6 is a schematic diagram of the embodiment 3.

Preferably, the delay action component is an elastic component which is engaged with the first sealing section. As illustrated in FIG. 6, the elastic component in the embodiment is a spiral spring 19. Obviously, by adoption of the ink cartridge refilling device with the above structure, during the ink refilling, namely when the cover component 14 performs clockwise rotation around a shaft, the spring 19 is compressed to produce a compressive force to drive the first sealing section to be closely engaged with the air inlet 23. After the ink refilling, namely when the cover component 14 performs counterclockwise rotation around the shaft, the first sealing section is still in the state of sealing the air inlet 23 when the second sealing section is driven to open the air inlet channel 12 due to the application of the compressive force and can only be detached from the air inlet 23 when the compressive force is canceled after the cover component 14 is rotated to a certain angle and the spring 19 moves upwards along with the movement of the cover component 14. By adoption of the structure, when the sealing of the ink cartridge is canceled, there is still certain negative pressure in the ink cartridge 2 but the negative pressure is not large, so that the sponge 211 and the cotton core 221 can have more ink and can be guaranteed to be not in the supersaturated state, thus the ink dropping phenomenon can be prevented. Moreover, the first sealing section illustrated in the above process can be the first elastic pad, can be the convex section and the elastic sleeve, and can also be other similar sealing components. The structure of the first sealing section is numerous and is not explained in detail here.

Other structures of the embodiment are similar to those of the embodiment 1 or 2 and are not explained in detail here.

It should be understood by those skilled in the art that the ink cartridge can also be an ink cartridge without an ink storage cavity and only with a sponge, namely the refilling device and the refilling method are also applicable to the ink cartridge for refilling.

It should be understood by those skilled in the art that the extended clamp hook(s) can be one or more than two and the position and the number of the clamping grooves correspond to those of the extended clamp hook(s).

It should be understood by those skilled in the art that the cover component can also perform up-and-down parallel movement relative to the ink cartridge positioning mechanism, and herein the cover component and the ink cartridge positioning mechanism can also be connected with each other through the engagement of the extended clamp hooks and the clamping grooves.

It should be understood by those skilled in the art that the sealing and opening actions of the first sealing section and the second sealing section on the cover component can be performed at the same time, namely the opening of the air inlet channel and the canceling of the sealing of the ink cartridge after the ink refilling can be carried out at the same time. But in the case, more redundant ink in the sponge can flow back to the ink container compared with the embodiment 1 or 2, and the ink dropping phenomenon can also be prevented.

It should be understood by those skilled in the art that the ink cartridge refilling device can also be made of non-transparent materials. If so, it can be determined that the ink cartridge is filled with ink when there is ink in the aspirator during the ink refilling, and a user only needs to enable redundant ink in the aspirator to be refilled into the ink container again after the ink refilling.

In summary, by adoption of the technical proposal, the ink container and the ink cartridge are driven to be in the pressure unbalance state during the ink refilling and be in the pressure balance state after the ink refilling, namely the refilling of ink into the ink cartridge and the replenishing of air into the ink container are not performed at the same time, thus redundant ink in the sponge and the cotton core in the ink cartridge can be removed, consequently the ink dropping phenomenon can be prevented.

The embodiments are only used for describing the technical proposal of the invention. It should be noted that various deformations and modifications can be made by those skilled in the art on the premise of not deviating from the concept of the invention and are all within the scope of protection of the invention.

What is claimed is:

1. A negative-pressure ink cartridge refilling device for refilling ink into an ink cartridge to be refilled, comprising an ink container used for storing ink for refilling;

an ink injection channel communicated with said ink container and used for conveying said ink in said ink container to said ink cartridge to be refilled;

an air inlet channel communicated with said ink container and used for replenishing air into said ink container;

an aspirator used for sucking air in said ink cartridge to be refilled; and a cover component, wherein said cover component is provided with a first sealing section for sealing said ink cartridge to be refilled and a second sealing section for sealing said air inlet channel.

2. The ink cartridge refilling device according to claim 1, wherein said ink cartridge refilling device also comprises an ink cartridge positioning mechanism for positioning said ink cartridge to be refilled on said ink cartridge refilling device; and said ink cartridge positioning mechanism is connected with said cover component through a rotating shaft.

3. The ink cartridge refilling device according to claim 2, wherein said first sealing section is closer to said rotating shaft compared with said second sealing section.

4. The ink cartridge refilling device according to claim 2, wherein said cover component is also provided with extended clamp hooks and said positioning mechanism is provided with clamping grooves which are engaged with said extended clamp hooks.

5. The ink cartridge refilling device according to claim 1, wherein said first sealing section is a first elastic pad which is arranged on said cover component and said second sealing section is a second elastic pad which is arranged on said cover component.

6. The ink cartridge refilling device according to claim 5, wherein a deformation of said first elastic pad is larger than that of said second elastic pad.

7. The ink cartridge refilling device according to claim 1, wherein said first sealing section consists of a convex section which is convex from said cover component and an elastic sleeve which is engaged with said convex section.

8. The ink cartridge refilling device according to claim 7, wherein said second sealing section consists of an extended section which is extended from said cover component and a sealing element which is engaged with said extended section.

9. The ink cartridge refilling device according to claim 8, wherein a deformation of said elastic sleeve is larger than that of said sealing element.

10. The ink cartridge refilling device according to claim 1, wherein said ink cartridge refilling device is also provided with a delay action component which enables said first sealing section to be still in the state of sealing said ink cartridge to be refilled after said air inlet channel is opened by said second sealing section.

11. The ink cartridge refilling device according to claim 10, wherein said delay action component is an elastic component which is engaged with said first sealing section.

12. A negative-pressure ink cartridge refilling system, comprising an ink cartridge to be refilled and an ink cartridge refilling device according to claim 1.

13. The ink cartridge refilling system according to claim 12, wherein said ink cartridge to be refilled comprises a cavity for storing ink, a sponge arranged inside said cavity for maintaining the negative pressure in said ink cartridge, an ink outlet for introducing ink in an ink storage cavity to the outside of said ink cartridge, an air inlet for replenishing air into said ink storage cavity and an ink injection opening for injecting ink into said ink storage cavity.

14. The ink cartridge refilling system according to claim 13, wherein said cavity is divided into said ink storage cavity for receiving said ink and a negative-pressure cavity for receiving said sponge.

15. The ink cartridge refilling system according to claim 13, wherein said first sealing section is arranged on said cover component, at a position corresponding to said air inlet of said ink cartridge to be refilled.

16. The ink cartridge refilling system according to claim 15, wherein a through hole is reserved on said cover component, at a position corresponding to said ink injection opening of said ink cartridge to be refilled.

17. The ink cartridge refilling system according to claim 16, wherein a movable mandrel is arranged at said through hole and used for removing said sealing element for sealing said ink injection opening.

18. A refilling method for utilizing an ink cartridge refilling system according to claim 12 for ink cartridge refilling, comprising the following steps of:

(A) sealing said ink cartridge to be refilled and said air inlet channel to form a closed space between said ink cartridge to be refilled and said ink cartridge refilling device;

(B) sucking air in said ink cartridge to be refilled by said aspirator; and (C) opening said air inlet channel and canceling the sealing of said ink cartridge to be refilled.

19. The refilling method according to claim 18, wherein said refilling method also comprises the following step before the step A: opening said ink injection opening of said ink cartridge to be refilled, and assembling a rubber plug into said ink injection opening.

20. The refilling method according to claim 19, wherein said refilling method also comprises the following step after the step C is over: taking off said ink cartridge to be refilled from said ink cartridge refilling device, and sealing said air inlet channel again.

21. The refilling method according to claim 18, wherein in the step C, said air inlet channel is opened first, and then the sealing of said ink cartridge to be refilled is canceled.

22. The refilling method according to claim 18, wherein in the step C, said air inlet channel is opened and simultaneously the sealing of said ink cartridge to be refilled is canceled.

* * * * *